US007311131B2

(12) United States Patent
Nien et al.

(10) Patent No.: US 7,311,131 B2
(45) Date of Patent: Dec. 25, 2007

(54) ROLLING MECHANISM FOR WINDOW BLIND

(75) Inventors: Ming Nien, Changhua Hsien (TW); Yuche Wen, Gueishan Township, Taoyuan County (TW); Chih-Yao Chang, Taichung (TW)

(73) Assignee: Nien Made Enterprise Co., Ltd., Taichung (TW)

( * ) Notice: Subject to any disclaimer, the term of this patent is extended or adjusted under 35 U.S.C. 154(b) by 278 days.

(21) Appl. No.: 10/917,363

(22) Filed: Aug. 13, 2004

(65) Prior Publication Data

US 2005/0247410 A1 Nov. 10, 2005

(30) Foreign Application Priority Data

May 10, 2004 (TW) ..... 93207261 U

(51) Int. Cl.
*E06B 9/08* (2006.01)

(52) U.S. Cl. ..... 160/121.1; 160/84.05; 160/302

(58) Field of Classification Search ..... 160/84.05, 160/121.1, 300, 293.1, 302, 168.1 R; 242/396, 242/396.1, 396.2, 396.4, 382
See application file for complete search history.

(56) References Cited

U.S. PATENT DOCUMENTS 1,153,015 A * 9/1915 Bauer ..... 160/300
1,171,215 A * 2/1916 Lane ..... 160/300
1,240,179 A * 9/1917 Cunningham ..... 160/294
4,958,458 A * 9/1990 Hillstrom et al. ..... 40/793
5,855,235 A * 1/1999 Colson et al. ..... 160/121.1
6,299,115 B1 * 10/2001 Kovach et al. ..... 248/262
2001/0001414 A1 * 5/2001 Colson et al. ..... 160/178.1 R
2005/0194104 A1 * 9/2005 Nien ..... 160/84.05

FOREIGN PATENT DOCUMENTS

TW 09320403160 * 5/2004

* cited by examiner

*Primary Examiner*—Blair M. Johnson
(74) *Attorney, Agent, or Firm*—Birch, Stewart, Kolasch & Birch, LLP

(57) ABSTRACT

A rolling mechanism includes a base frame fastened to a top side of a window and having a coupling flange, a roller rotatably mounted below the base frame for stationary rotation and having a locating groove on its periphery, and at least one constraint member having a coupling portion pivotally coupled to the coupling flange of the base frame and a constraint portion extending from the coupling portion for engaging the locating groove of the roller and further limiting the rotary direction of the roller to one direction only.

10 Claims, 8 Drawing Sheets

ROLLING MECHANISM FOR WINDOW BLIND

This Non-provisional application claims priority under 35 U.S.C. 119(a) on Patent Application No(s). 093207261 filed in Taiwan, Republic of China on May 10, 2004, the entire contents of which are hereby incorporated by reference.

BACKGROUND OF THE INVENTION

1. Field of the Invention

The present invention relates to window blinds, and more specifically to a rolling mechanism for preventing roller of a window blind from reverse rolling.

2. Description of the Related Art

A conventional window blind, such as a roller-typed shade, as shown in FIGS. 1 and 2, essentially is comprised of a roller 1 and a shade 2. The roller 1 is rotatably mounted at a top side of a window for stationary rotation driven by an external force generally generated from a rolling mechanism having an endless lifting cord or chain and connected with the roller 1. The shade 2 has an end fastened to an outer periphery of the roller 1 and a free end suspended from the roller 1 for blinding the window to further block the light. When operating the rolling mechanism to rotate the roller 1 counterclockwise, the shade 2 is released downwards at the left side of the roller 1 in FIG. 1 to block the light. When the roller 1 is continuously rotated counterclockwise after the shade 2 has been fully released, the roller 1 rolls up the shade 2 at its right side as shown in FIG. 2. When viewing the window blind from the inside of the house, the shade 2 is suspended from the roller 1 at its rear side (the right side in FIG. 2), aesthetically spoiling the window blind. According to the aforesaid design, the roller fails be firmly positioned after the shade fully released, thereby ineffectively blinding the window.

SUMMARY OF THE INVENTION

The present invention has been accomplished under the circumstances in view. It is the main object of the present invention to provide an improved rolling mechanism for a window blind; the rolling mechanism allows only one rotary direction of the roller for rolling up a shade. It is another object of the present invention to provide an improved rolling mechanism for a window blind; the rolling mechanism keeps the roller firmly in position when the shade is fully released.

To achieve the foregoing objects of the present invention, the rolling mechanism is comprised of a base frame fastened to a top side of a window and having a coupling flange, a roller rotatably mounted below the base frame for stationary rotation driven by an external force and having a locating groove on its periphery, and at least one constraint member having a coupling portion pivotally coupled to the coupling flange of the base frame and a constraint portion extending from the coupling portion for engaging the locating groove of the roller and further limiting the rotary direction of the roller to one direction only.

DETAILED DESCRIPTION OF THE INVENTION

Figure 1:
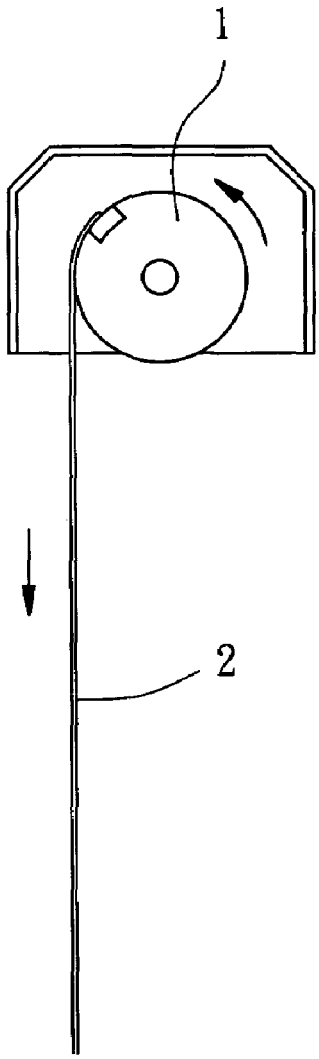
FIG. 1 PRIOR ART
FIG. 1 is a schematic view of a prior art, showing that a shade is released downward counterclockwise.
Figure 2:
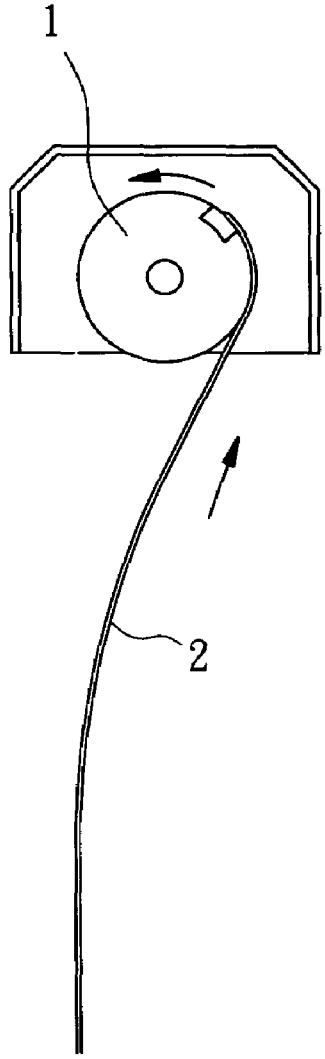
FIG. 2 PRIOR ART
FIG. 2 is a schematic view of the prior art, showing that the shade is rolled up clockwise.
Figure 3:
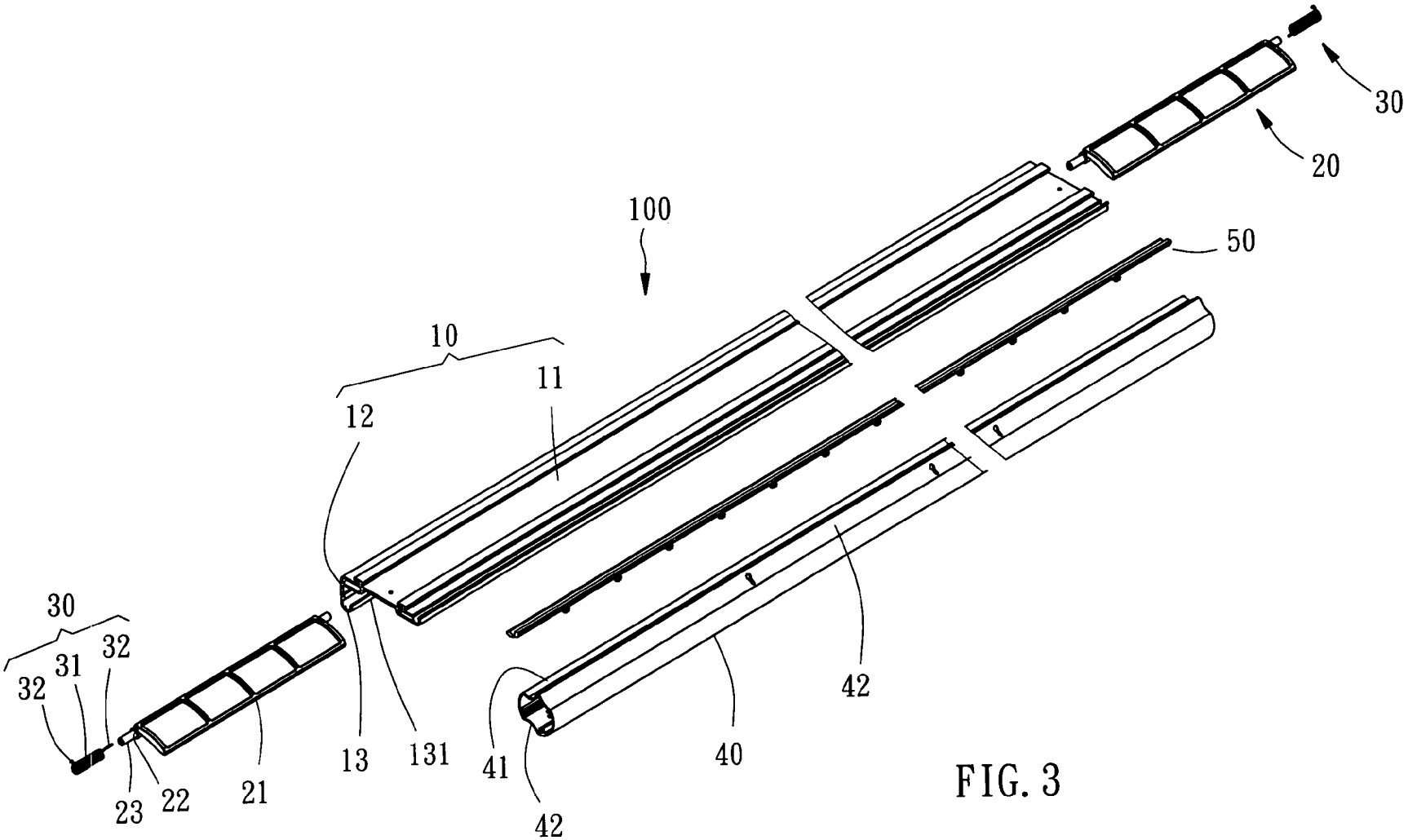
FIG. 3 is an exploded view of a first preferred embodiment of the present invention.
Figure 4:
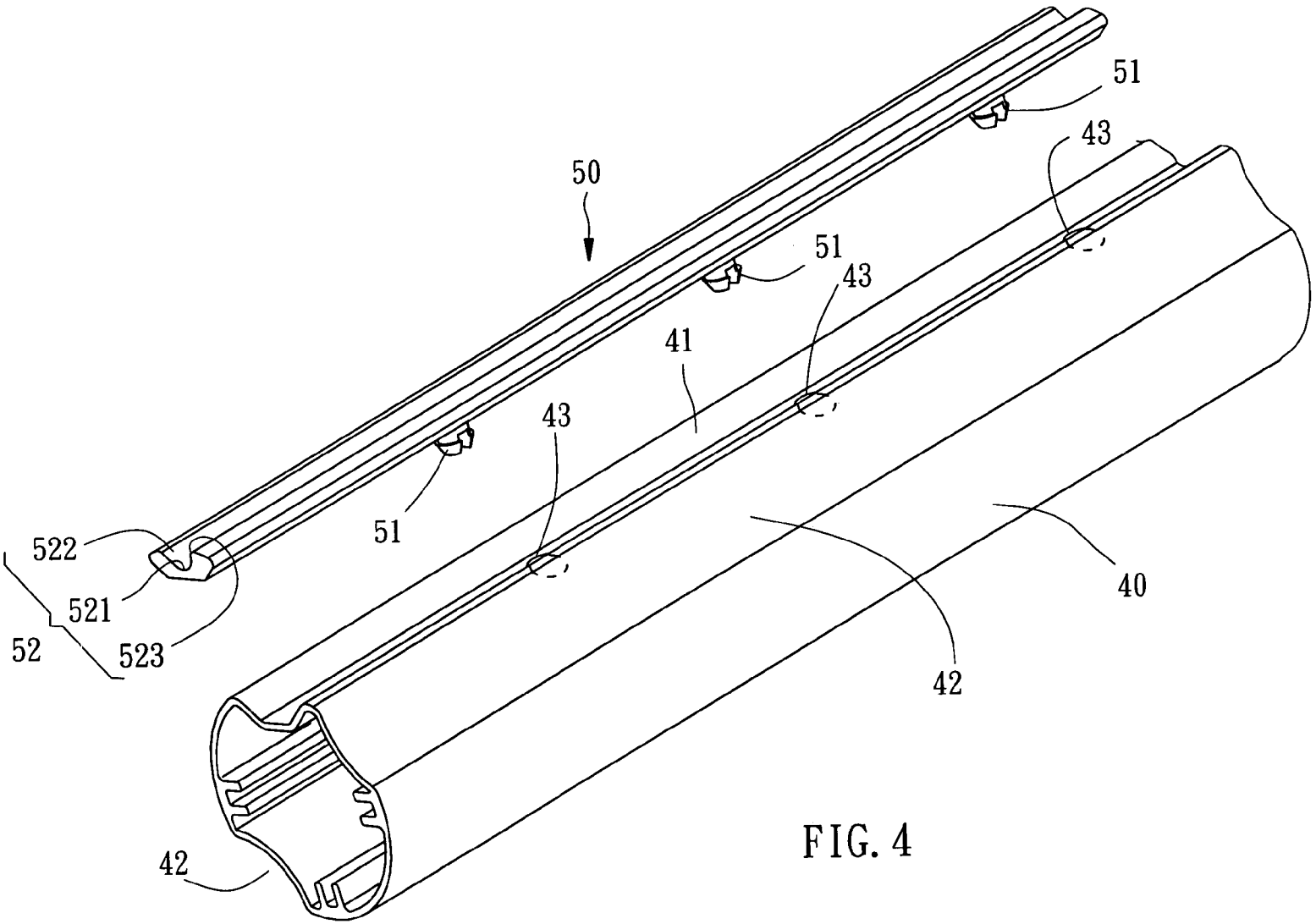
FIG. 4 is a partial enlarged view of the first preferred embodiment of the present invention.
Figure 5:
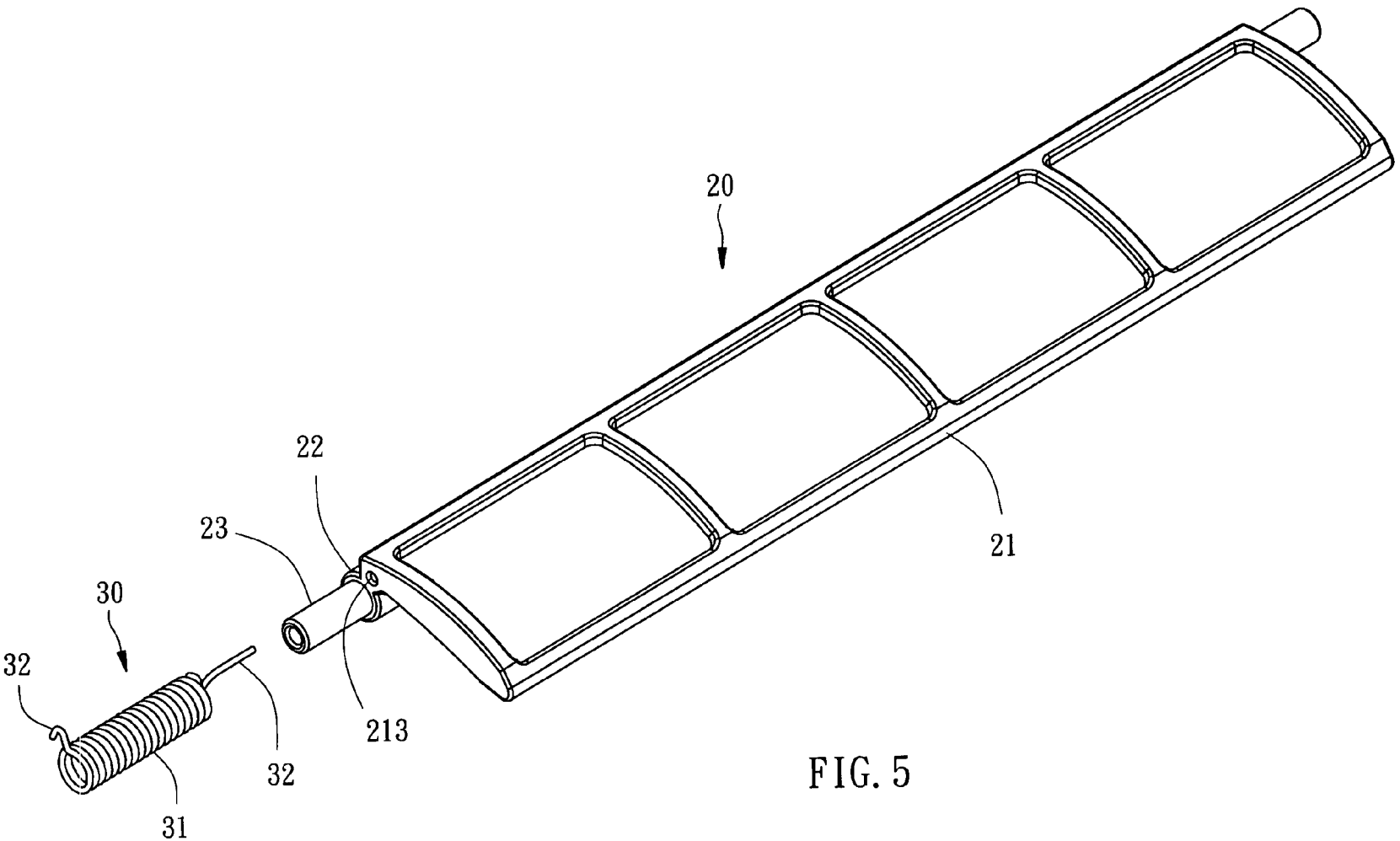
FIG. 5 is another partial enlarged view of the first preferred embodiment of the present invention.

Referring to FIGS. 3-5, a rolling mechanism 100 for a window blind in accordance with a first preferred embodiment of the present invention is shown comprised of a base frame 10, at least one constraint member (two constraint members) 20, at least one springy member (four springy members) 30, a roller 40, and a locating member 50.

The base frame 10 is shaped like a L-shaped elongated bar and fastened to a top side of a window, including an elongated first frame panel 11 and an elongated second frame panel 12 arranged at a right angle. The second frame panel 12 extends outwards from the first frame panel 11, having a coupling flange 13 of circular cross-section, an elongated opening 131 formed over the coupling flange 13, and a longitudinal retaining groove 14 formed on an inner wall of the coupling flange 13 (see FIG. 6).

The constraint members 20 are identical to each other and respectively coupled to two distal ends of the coupling flange 13 of the base frame 10 and pivotable in the coupling flange 13 within a limited angle, each having a constraint portion 21 and a coupling portion 22. The constraint portion 21 is a flat elongated member, having two locating holes 213 respectively formed at two distal ends thereof and axially located in alignment with each other. The coupling portion 22 is a cylindrical member extending from a long side of the constraint portion 21 and pivotally coupled to the coupling flange 13 of the base frame 10, having two cylindrical extensions 23 respectively axially extending from two distal ends thereof. The outer diameter of the coupling portion 22 is slightly smaller than the inner diameter of the coupling flange 13 of the base frame 10. The outer diameter of the cylindrical extensions 23 is slightly smaller than that of the coupling portion 22.

The springy members 30 are spiral springs coupled between the constraint members 20 and the base frame 10 for biasing the constraint members 20 toward a predetermined direction, each having a spiral body portion 31 and two mounting tips (free end edges) respectively extending outwards from two distal ends of the body portion 31. The body portion 31 defines therein an insertion space. It is to be noted that there are only two springy members 30 shown in the drawing for concision.

The roller 40 is a hollow cylindrical member rotatably mounted at a top side of the window for stationary rotation driven by an external force on its own axis and horizontally (transversely) suspended below the base frame 10, having a recessed locating portion 41 longitudinally formed on a peripheral wall thereof, two recessed receiving portions 42 longitudinally formed on the peripheral wall thereof, and a plurality of locating holes 43 formed on the recessed locating portion 41 and arranged at an equal interval.

The locating member 50 is an elongated bar for fixedly engaging the recessed locating portion 41 of the roller 40, having a plurality of mounting blocks 51 protruded from a bottom side thereof and corresponding to the locating holes 43 of the roller 40, and a locating groove 52 longitudinally extending to two distal ends of a top side thereof. The locating groove 52 is in complementary shape with the recessed locating portion 41. The locating groove 52 has a bottom wall 521, a beveled sliding wall 522 extending upwards from a lateral side of the bottom wall 521, and a beveled stop wall 523 extending upwards from the opposite lateral side of the bottom wall 521. The sliding wall 522 is relative to the bottom wall 521 at an angle larger than 90°. The stop wall 523 is relative to the bottom wall 521 at an angle smaller than 90°, being bent towards the sliding wall 522.

Figure 6:
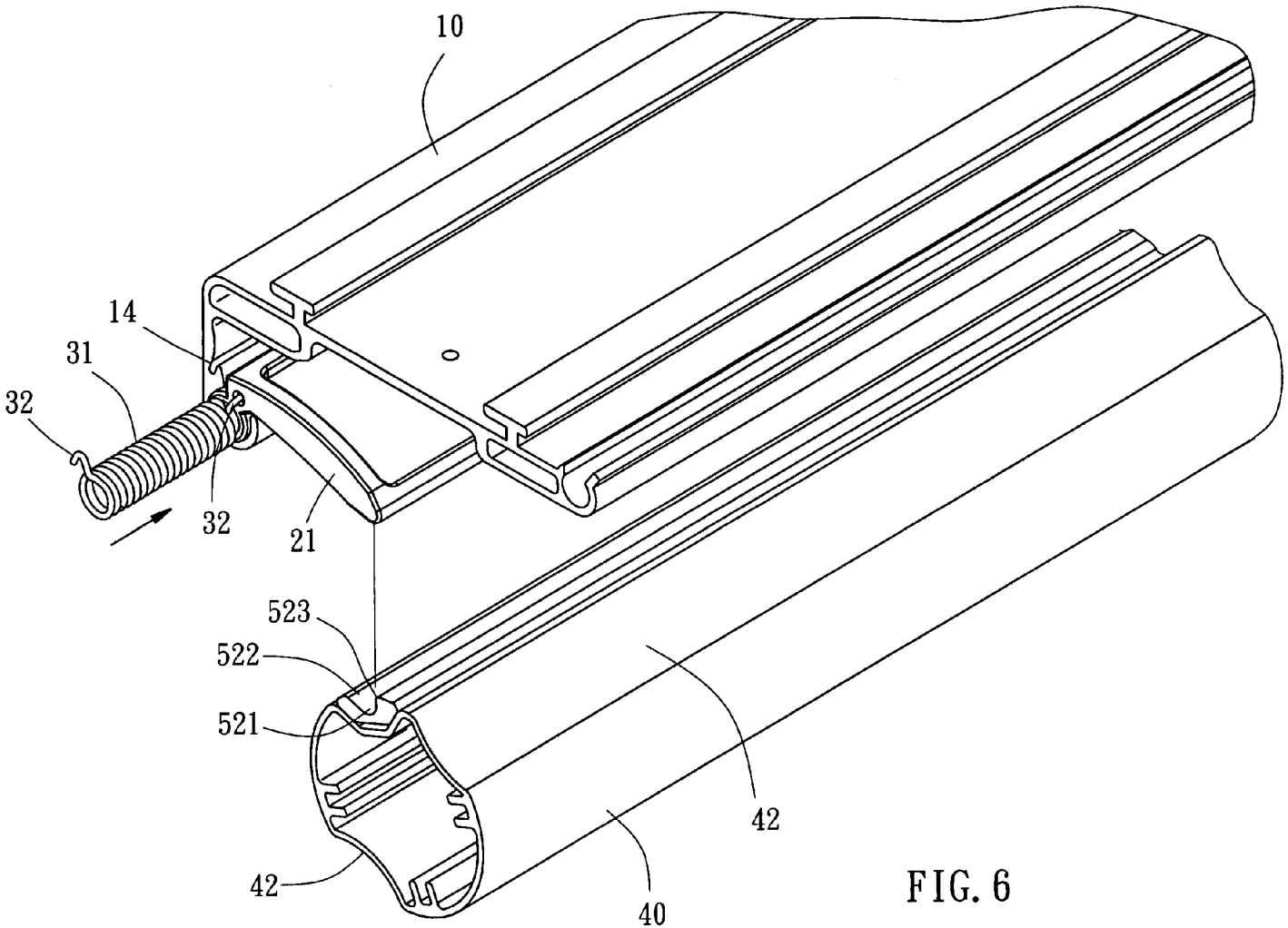
FIG. 6 is a perspective view of the first preferred embodiment of the present invention.
Figure 7:
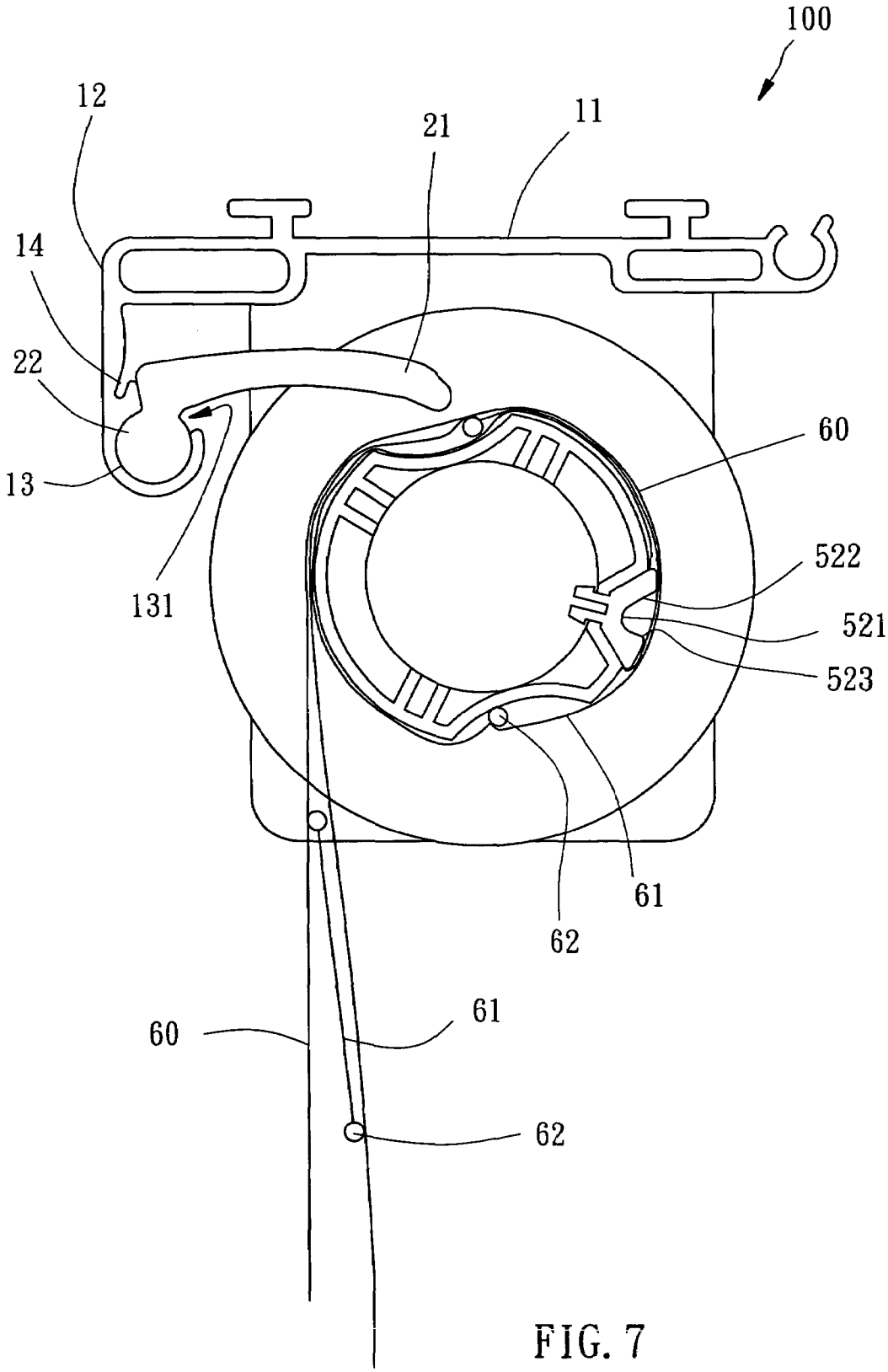
FIG. 7 is a partial sectional view of the first preferred embodiment of the present invention at work.
Figure 8:
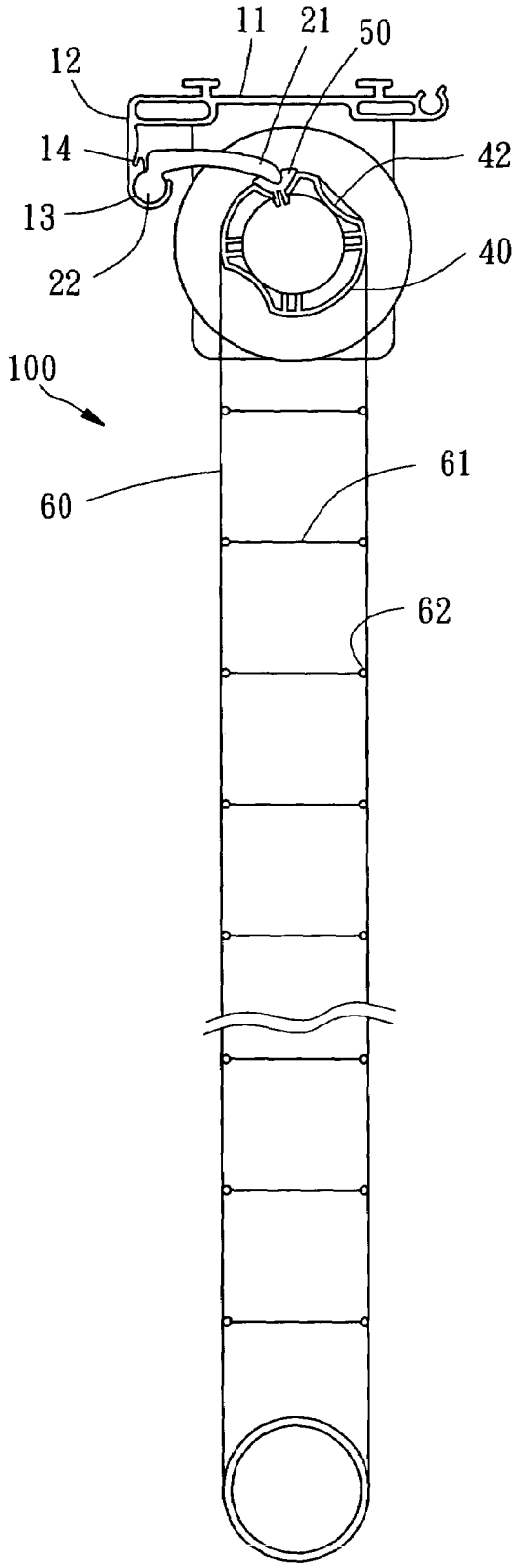
FIG. 8 is a sectional view of the first preferred embodiment of the present invention at work.

The installation of the rolling mechanism 100 is outlined hereinafter with reference to FIGS. 6-8. At first, the base frame 10 is horizontally (transversely) fixed to the top side of the window, and then the two coupling portions 22 of the constraint members 20 are respectively inserted into the coupling flange 13 from two distal ends of the base frame 10 to enable the constraint portions 21 of the constraint members 20 to protrude over the opening 131 of the coupling flange 13, and then the body portions 31 of the springy members 30 are respectively sleeved onto the cylindrical extensions 23 of the springy members 20 to have the two mounting tips 32 of each springy member 30 respectively fastened to the locating holes 213 of the constraint members 20 and the longitudinal retaining groove 14 of the base frame 10 to further enable the constraint members 20 to generate a downward biasing prestress. Next, the roller 40 is horizontally (transversely) rotatably mounted below the base frame 10 for stationary rotation on the axis thereof by an external biasing force; for example, the operation of a lifting cord/chain, and however, means for driving the rotation of the roller 40 is of the known art and therefore no further detailed description at this regard is necessary; and then the mounting blocks 51 of the locating members 50 are respectively fastened to the locating holes 43 of the roller 40 to affix an end of a blind/shade, such as double-layer shade 60, to the recessed locating portion 41 of the roller 40. When installed, the double-layer shade 60 is suspended from a peripheral side of the roller 40 for blinding the light from outside of the window.

The operation of the rolling mechanism 100 is outlined hereinafter with reference to FIGS. 7 and 8. When in use, rotate the roller 40 (counterclockwise as shown in FIG. 7) to release the shade 60 downwards for blinding the window. Because the roller 40 has a part of the shade 60 to cover the locating groove 52, the shade 60 keep the constraint members 20 from interaction with the locating groove 52 of the locating member 50, such that the roller 40 can be rotated counterclockwise). After the shade 60 is fully released as shown in FIG. 8, the shade 60 is removed from the locating groove 52 of the locating member 50, and the constraint portions 21 are forced by the springy members 30 to jam the locating groove 52 to engage the stop wall 523 and to further stop the roller 40 from counterclockwise rotation, and therefore the roller 40 is prohibited from rolling up the shade 60 at its right side. When the user intends to roll up the shade 60, the user must rotate the roller 40 clockwise to move the constraint portions 21 of the constraint members 20 from the stop wall 523 of the locating groove 52 to the sliding wall 522 to further move the constraint members 20 away from the locating groove 52 of the locating member 50, and therefore the roller 40 can smoothly be rotated clockwise to roll up the shade 60 at its left side.

From the above recitation, the matching design between the constraint members 20 and the locating groove 52 of the locating member 50 enables the roller 40 to roll up the shade 60 at its one single side only, thereby maintaining the aesthetic appearance of the present invention.

Referring to FIG. 7 again, the two recessed receiving portions 42 of the roller 40 are spaced from each other at an interval. The double-layer shade 60 has fabric slats 61 provided between two fabric layers at different elevations. Each fabric slat 61 has two opposite long sides each mounted with a support rod 62 for smoothing the slats 61. When rolling up the shade 60, the support rods 62 of the fabric slats 61 will be received in the recessed receiving portions 42 of the roller 40, and therefore the shade 60 can be smoothly wound round the periphery of the roller 40, preventing the support rods 62 from wrinkling the shade 60 and the fabric slats 61.

Figure 9:
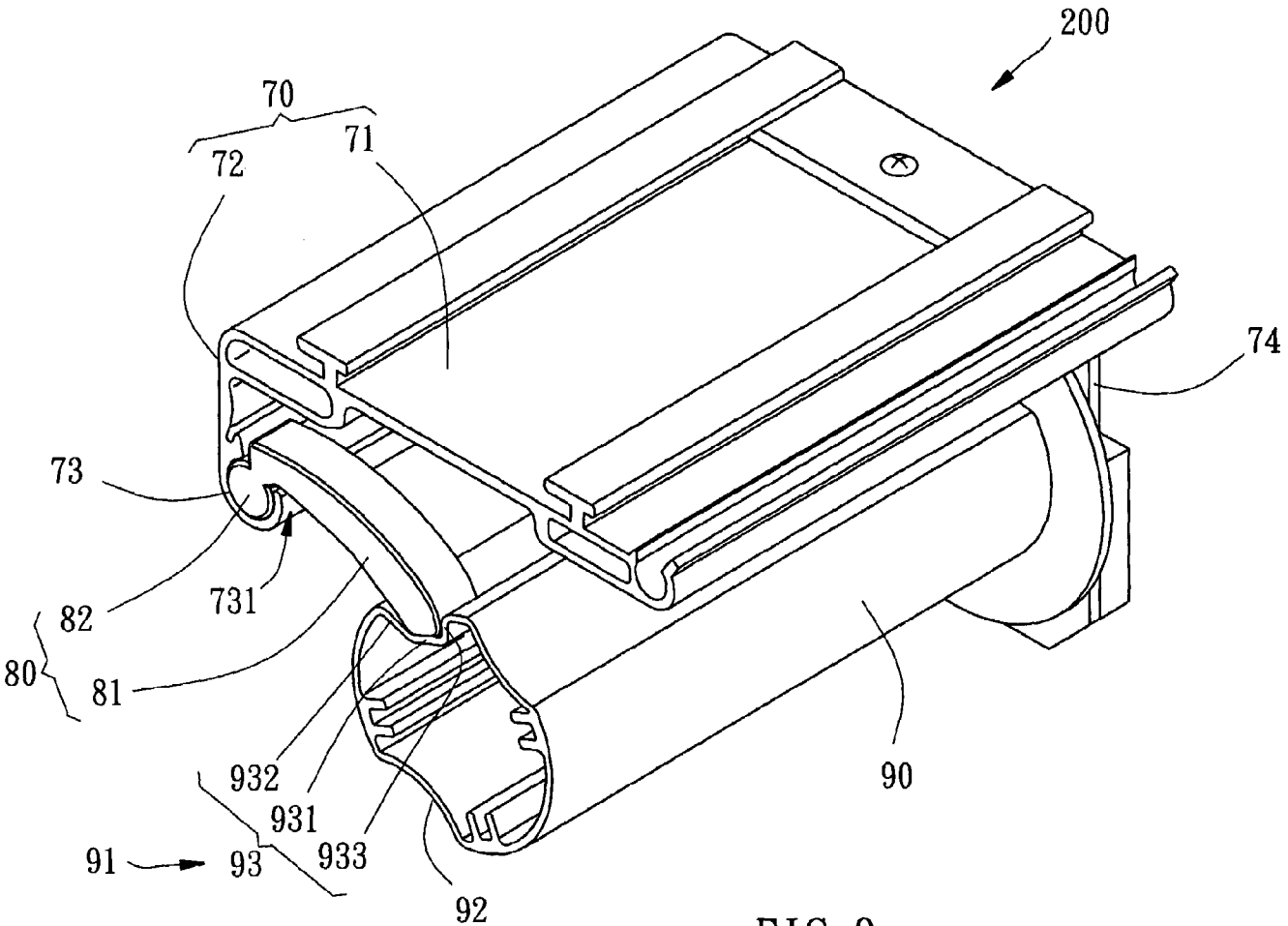
FIG. 9 is a perspective view of a second preferred embodiment of the present invention.

FIG. 9 shows the rolling mechanism 200 in accordance with a second preferred embodiment of the present invention. According to this preferred embodiment, the rolling mechanism 200 is comprised of a base frame 70, at least one constraint member 80, and a roller 90.

The base frame 70 is substantially similar to the aforesaid base frame 10 of the first preferred embodiment, having an elongated first frame panel 71 and an elongated second frame panel 72 substantially arranged at a right angle, a coupling flange 73 extending from a side of the second frame panel 72 and defining a longitudinally extending opening 731, and two mounting flanges 74 extending downwards from two lateral sides of the first frame panel 71. It is to be noted that only one mounting wall 74 is shown in FIG. 9.

The constraint member 80 is a block member having a constraint portion 81 and a coupling portion 82. The coupling portion 82 is shaped like a cylindrical member pivotally coupled to the coupling flange 73 of the base frame 70. The constraint portion 81 is shaped like a rectangular block extending outwards from a long side of the constraint portion 81.

The roller 90 is an elongated hollow cylindrical member rotatably mounted between the mounting flanges 74 of the base frame 70 having a recessed locating portion 91 longitudinally formed on the peripheral wall thereof and two recessed receiving portions 92 longitudinally formed on the peripheral wall thereof. The recessed locating portion 91 is a locating groove 93, which has a bottom wall 931, a sliding wall 932, and a stop wall 933.

After installation of the coupling portion 82 in the coupling flange 73 of the base frame 70, the constraint portion 81 extends over the opening 731 and is forced by its gravity to fall downwards and to jam the roller 90.

Immediately after the shade (not shown) is fully released, the constraint portion 81 of the constraint member 80 is forced by the gravity of the constraint member 80 to engage the recessed locating portion 91 of the roller 90, and therefore the roller 90 is allowed to be rotated to roll up the shade in one direction only. Further, the sliding wall 932 guides smooth movement of the constraint portion 81 over the roller 90 when rolling up the shade.

What is claimed is:

1. A rolling mechanism for a window blind, said window blind having fabric slats and support rods, said rolling mechanism comprising:

a base frame fastened to a top side of a window and having a coupling flange;

a roller rotatably mounted below said base frame for stationary rotation and having a locating groove formed on an outer periphery of said roller;

a constraint member coupled to said base frame for limiting the rotary direction of said roller to one direction only, said constraint member having a coupling portion pivotally coupled to the coupling flange of said base frame and a constraint portion extending outwards from said coupling portion for engaging said locating groove with said roller to limit the rotary direction rotation of said roller to one direction; and at least one springy member connected between said base frame and said constraint member for forcing said constraint portion of said constraint member into engagement with said locating groove at said roller, wherein said base frame further comprises a retaining groove; said constraint member further comprises a locating hole; said springy member comprises two mounting tips respectively extending from two opposite ends thereof and respectively fastened to said retaining groove of said base frame and said locating hole of said constraint member.

2. The rolling mechanism as defined in claim 1, wherein said base frame comprises a first frame panel and a second frame panel, said first and second frame panels being connected at a right angle.

3. The rolling mechanism as defined in claim 2, wherein said base frame further comprises two mounting flanges vertically downwardly extending respectively from two distal ends of said first frame panel for supporting said roller.

4. The rolling mechanism as defined in claim 2, wherein said coupling flange of said base frame is fanned on an inner side of said second frame panel and comprises a circular cross-section; said coupling portion of said constraint member is a cylindrical member having an outer diameter slightly smaller than an inner diameter of said coupling flange.

5. The rolling mechanism as defined in claim 1, wherein said coupling flange of said base frame defines an opening for enabling said constraint portion of said constraint member, said opening having a predetermined width for enabling said constraint portion of said constraint member to pivot within an angle defined by the width of said opening of said coupling flange.

6. The rolling mechanism as defined in claim 1, wherein said coupling portion of said constraint member comprises at least one extension; said springy member comprises a body sleeved onto said extension of said coupling portion of said constraint member.

7. The rolling mechanism as defined in claim 1, wherein said roller comprises two recessed receiving portions formed on the outer periphery thereof for receiving said support rods of said fabric slats of said window blind connected to said roller.

8. A rolling mechanism for a window blind, said window blind having fabric slats and support rods, said rolling mechanism comprising:

a base frame fastened to a top side of a window and having a coupling flange;

a roller rotatably mounted below said base frame for stationary rotation and having a locating groove formed on an outer periphery of said roller;

a constraint member coupled to said base frame for limiting the rotary direction of said roller to one direction only, said constraint member having a coupling portion pivotally coupled to the coupling flange of said base frame and a constraint portion extending outwards from said coupling portion for engaging said locating groove with said roller to limit the rotary direction rotation of said roller to one direction, wherein said locating groove of said roller comprises a bottom wall, a sliding wall extending from a first lateral side of said bottom wall and being respective to said bottom wall at an angle larger than 90°, and a stop wall extending from a second lateral side of said bottom wall and bent toward said sliding wall and being respective to said bottom wan at an angle smaller than 90°, whereby while rotating said roller in one direction causes said sliding wall to move over the constraint portion of said constraint member; rotating said roller in the reversed direction causes said stop wall to jam said constraint portion of said constraint member.

9. A rolling mechanism for a window blind, said window blind having fabric slats and support rods, said rolling mechanism comprising:

a base frame fastened to a top side of a window and having a coupling flange;

a roller rotatably mounted below said base frame for stationary rotation and having a locating groove formed on an outer periphery of said roller;

a constraint member coupled to said base frame for limiting the rotary direction of said roller to one direction only, said constraint member having a coupling portion pivotally coupled to the coupling flange of said base frame and a constraint portion extending outwards from said coupling portion for engaging said locating groove with said roller to limit the rotary direction rotation of said roller to one direction; and a locating member mounted to said roller, said locating member having a plurality of mounting blocks protruded from a bottom side thereof and equally spaced from one another; said locating groove extends along a long side of a top side of said locating member, said roller having a recessed locating portion formed on the outer periphery thereof and a plurality of mounting holes formed on said recessed locating portion for receiving said mourning blocks of said locating member.

10. The rolling mechanism as defined in claim 9, wherein said locating groove comprises a bottom wall, a sliding wail extending from a first lateral side of said bottom wall and being respective to said bottom wall at an angle larger than 90°, and a stop wall extending from a second lateral side of said bottom wall and bent toward said sliding wall and being respective to said bottom wall at an angle smaller than 90°, whereby while rotating said roller in one direction causes said sliding wall to move over said constraint portion of said constraint member; rotating said roller in the reversed direction causes said stop wall to jam said constraint portion of said constraint member.

* * * * *